United States Patent [19]

Chen et al.

[11] Patent Number: 4,771,825

[45] Date of Patent: Sep. 20, 1988

[54] HEAT EXCHANGER HAVING REPLACEABLE EXTENDED HEAT EXCHANGE SURFACES

[76] Inventors: Hung-Tai Chen, 720 Chancellor Ave., Irvington, N.J. 07111; Sat-Hong Yu, 1535 Hastings Drive, London, Ontario, Canada, N5X 2C3

[21] Appl. No.: 1,923

[22] Filed: Jan. 8, 1987

[51] Int. Cl.[4] ..... F28D 1/04; F28F 1/20

[52] U.S. Cl. ..... 165/151; 165/172; 165/181

[58] Field of Search ..... 165/150, 151, 152, 172, 165/181, 76

[56] References Cited

U.S. PATENT DOCUMENTS

| | | | |
|---|---|---|---|
| 1,531,199 | 3/1925 | Lehman et al. | 165/151 |
| 1,821,754 | 9/1931 | Huyette | 165/151 X |
| 1,821,765 | 9/1931 | Newman | 165/151 X |
| 2,082,899 | 6/1937 | Norris | 165/164 |
| 2,112,743 | 3/1938 | Poole | 165/185 |
| 2,182,338 | 12/1939 | Gurlil | 165/150 |
| 2,187,555 | 1/1940 | Flindt | 165/150 X |
| 2,617,392 | 11/1952 | Donohue | 122/32 |
| 2,699,923 | 1/1955 | Walworth | 165/76 |
| 2,983,483 | 5/1961 | Modine | 165/151 X |
| 3,195,621 | 7/1965 | Van Geuns et al. | 165/10 |
| 3,262,190 | 7/1966 | Rostoker et al. | 29/157.3 |
| 3,395,754 | 8/1968 | French | 165/185 |
| 3,587,732 | 6/1971 | Burne | 165/158 |
| 3,776,303 | 12/1973 | Anderson et al. | 165/82 |
| 3,921,712 | 11/1975 | Renzi | 165/165 |
| 4,071,935 | 2/1978 | Molitor | 29/157.3 |
| 4,098,326 | 7/1978 | Waters | 165/76 |
| 4,222,434 | 9/1980 | Clyde | 165/10 |
| 4,540,045 | 9/1985 | Molitor | 165/164 |

*Primary Examiner*—Allen M. Ostrager
*Assistant Examiner*—Richard R. Cole
*Attorney, Agent, or Firm*—Watts, Hoffmann, Fisher & Heinke Co.

[57] ABSTRACT

A heat exchanger having replaceable heat exchange surfaces comprises a plurality of tubes formed into a bundle wherein the tubes are arranged linearly side by side. The heat exchanger is provided with a header and reverse header at either end of the tube bundle for directing the flow of fluid therethrough. A heat exchange structure is positionable about the tube bundle in thermal contact therewith. The heat exchange structure has a surface matrix from which extend a plurality of fins for receiving heat conducted from the tube bundle. The heat exchange structure may be conveniently formed into a U-shaped sleeve which may be slid over the tubes of the tube bundle and affixed in place by means of a thermal conductive cement. The tubes may be shaped to provide a streamlined flow of a cooling fluid about the fins thereby increasing the efficiency of heat transfer to the cooling fluid.

15 Claims, 3 Drawing Sheets

HEAT EXCHANGER HAVING REPLACEABLE EXTENDED HEAT EXCHANGE SURFACES

The present invention relates to a heat exchanger, and particularly to a heat exchanger having replaceable extended heat exchange surfaces. The invention pertains to a heat exchanger of the type having a plurality of tubes through which a heated fluid, such as liquid or vapor, flows and transfers heat to extended heat exchange surfaces, such as a plurality of fins, in thermal contact with the tubes. A cool fluid, such as air, flows past the fins to remove heat from the extended heat exchange surfaces.

In known heat exchangers of this type, the fins or other extended heat exchange surfaces tend to deteriorate over time due to corrosion or mechanical damage. Presently, it is a costly and time consuming task to replace worn out heat exchange surfaces. One aspect of the invention is to provide a replaceable heat exhange structure for the heat exchanger, which may be easily and quickly removed when it is worn out or when the thermal design of the device is revised; and replaced by a new structure. The structure may comprise a surface matrix having a plurality of outwardly extending fins which is held in thermal contact with the tubes of the heat exchanger by adhesive or mechanical means or both.

Other disadvantages associated with presently known heat exhangers include the inefficient flow of the cooling fluid along the extended heat exchange surfaces resulting in poor heat transfer, especially when the cooling fluid is a gas; and potentially damaging vibration caused by the low velocity wake region formed at the downstream sides of the heat exchanger tubes. Providing a more streamlined cross-sectional configuration for the tubes of the heat exchanger to which the heat exchange structure is conformed, results in a more efficient transfer of heat to the cooling fluid and a reduction in vibration.

Accordingly, the present invention provides a heat exchanger comprising a plurality of tubes formed into a bundle, wherein two or more tubes are arranged linearly side by side. A header structure is positioned at one end of the tube bundle to direct a flow of heated fluid into at least one tube of the bundle and to receive a flow of cooled fluid exiting from at least one other tube of the bundle. Means are located at the other end of the tube bundle for directing the flow of fluid from said one tube to said other tube of the bundle. One or more heat exchange structure is positionable about substantially the entire tube bundle in thermal contact therewith.

The heat exchange structure has a surface matrix which is provided with a plurality of outwardly extending fins for receiving heat conducted from the tube bundle to the surface matrix. The heat exchange structure is positioned about the tube bundle to receive a flow of cooling fluid about the fins so that heat may be transferred from the fins to the cooling fluid.

BRIEF DESCRIPTION OF THE DRAWINGS

As shown in FIG. 1, a heat exchanger 10 in accordance with the invention comprises a plurality of tubes 11 arranged in a bundle 12 linearly side by side. The heat exchanger 10 may have several such tube bundles 12 positioned adjacent one another so that the tubes 11 of each bundle 12 are parallel one another (FIG. 1) or arranged in a staggered configuration.

Figure 1:
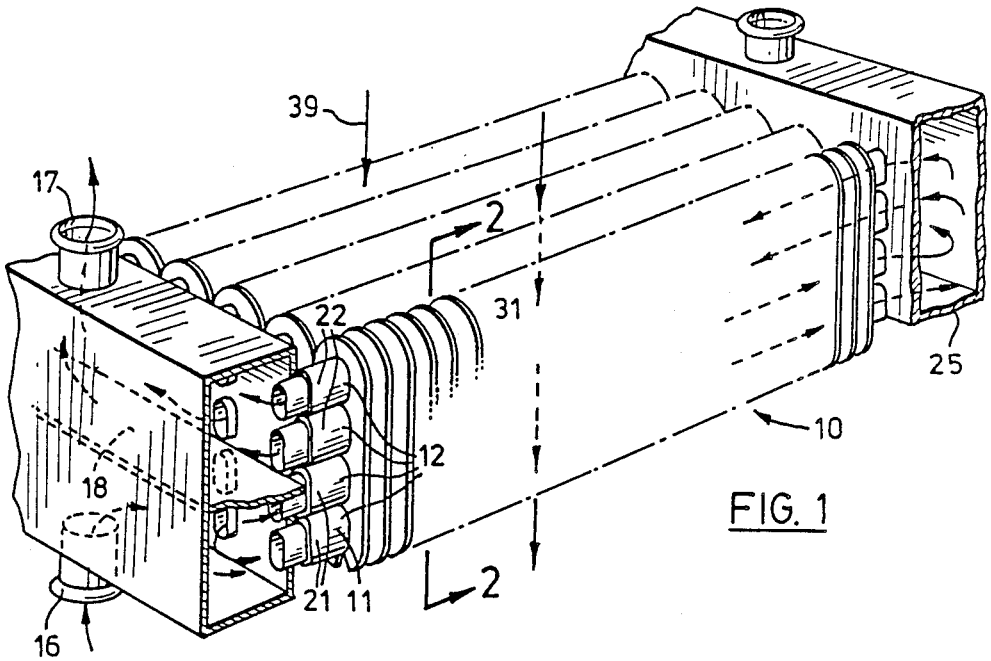
FIG. 1 is a perspective view partially broken away of a heat exchanger in accordance with the invention.

The tube bundles 12 shown in the drawings each comprise four matter of design choice. The heat exchanger 10 is provided with a header 15 at one end of the tube bundles 12. The header 15 has an inlet 16 and an outlet 17. An internal partition 18 may be provided within the header 15 to direct the flow of fluid from the inlet 16 into a first set of tubes 21 of each bundle 12, and from a second set of tubes 22 to the outlet 17. At the other end of the tube bundles 12 means are provided for directing the flow of fluid from the first set of tubes 21 to the second set of tubes 22. Such means may comprise a return header 25 as shown in FIG. 1, or more direct means such as tubing formed into a U-bend connecting a tube 11 from the first set 21 to a tube 11 of the second set 22. The number of tube-pass for the flow of fluid through the exchanger 10 is a matter of design choice.

Each tube bundle 12 is provided with a heat exchange structure 31. The heat exchange structure 31 preferably comprises a surface matrix 32 which is provided with a plurality of outwardly extending fins 33 (see FIG. 5). The heat exchange structure 31 is made of a heat conducting material such as metal so that the heat can be conducted from the tube bundle 12 to the fins 33 where the heat may be transferred to a passing stream of a cooling fluid such as air (arrow 39).

Figure 5:
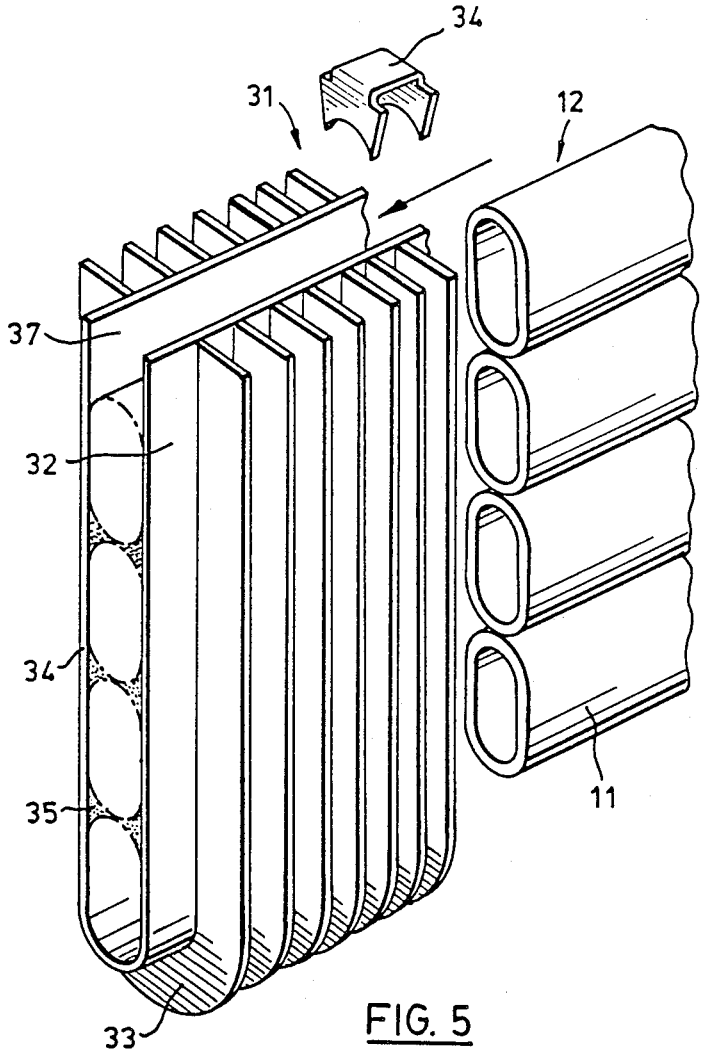
FIG. 5 is a perspective view of a heat exchanger structure which is formed for attachment about a tube bundle.

The basic heat exchange structure 31 is preferably formed as shown in FIG. 5 to conform to the exterior contour of the tube bundle 12. The formed heat exchange structure 31 may comprise a U-shaped sleeve 34 which may be slid over the tube bundle 12 and attached thereto by means of a commercially available heat conductive adhesive or cement 35 and mechanical means such as a clip 36 at the open end 37 of the sleeve 34 (FIG. 5). The heat exhange sleeve 34 is provided about the tube bundle 12 so that the maximum fin surface area is available to the cooling fluid stream passing through the heat exchanger 10.

A principal advantage of providing each tube bundle 12 with a heat exchange sleeve 34 as described, is that if necessary, the sleeve 34 can be removed and replaced with a new sleeve 34 on site and with minimal shutdown time for the heat exchanger 10. Thus, a sleeve 34 having fins 33 which have been damaged through corrosion or mechanical action may be removed by releasing the mechanical fasteners 36 and dissolving the conductive adhesive or cement 35. A new sleeve 34 can be attached to the tube bundle 12 and the heat exchanger 10 can quickly be back in operation.

In another aspect of the invention, it has been found that the efficiency of heat transfer from the fins 33 to the passing cooling fluid stream may be enchanced by providing a tube cross section of suitable fluid dynamic shape and by staggering the alignment of adjacent tube bundles 12. Since the cooling fluid is commonly air, and the convective heat transfer coefficient for gases is generally one or two orders of magnitude lower than that for liquids or vapors, this preferred feature of the invention is particularly advantageous for heat exchangers in which heat is transferred to gas from a liquid or condensing vapor flowing through the tubes 11 of the device. The selection of an optimum profile for the assembled tube bundle 12 and heat exchange sleeve 34 can minimize the low velocity wake zone downstream of each tube 11 and therefore, yield a higher heat transfer coefficient.

For example, the flow geometry of a fluid stream passing around a tube 11, having a circular cross section is such that in the downstream low velocity wake region, the heat transfer coefficient is only about 10% of the overall value. In addition, with a tube 11 having a circular cross section, this form drag accounts for 40 to 60% of the downstream pressure drop.

The present invention provides an optimization of the flow geometry of the cooling fluid passing along the finned surface of the heat exchanger 10 by wrapping a heat exchange sleeve 34 about a tube bundle 12 so that the finned heat exchange structure 31 conforms to the curvature of the exterior surface of the tube bundle 12. Thus, the heat exchange sleeve 34 is deformed about the tube bundle 12 to provide a corrugated profile for the fins 33 (see FIGS. 2–4). Referring to FIG. 3, the inefficient heat transfer provided by a tube 11 having a circular cross section may be significantly improved by utilizing the finned heat exchange sleeve 34 to streamline the profile of the tubes 11 in the bundle 12. The sleeve 34 is formed about the tubes 11 of the bundle 12 with the aid of an interconnecting thermal conductivity cement 35 so that the circular cross section of the tubes 11 shown in FIG. 3 are altered to an oval or tear drop shape having more favorable drag characteristics.

Figure 2:
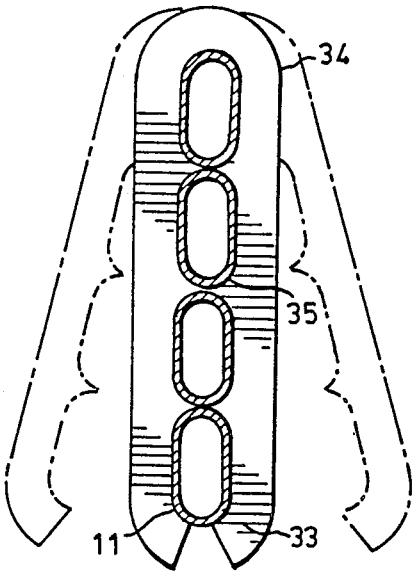
FIGS. 2–4 are sectional views taken through line 2—2 in FIG. 1 showing several preferred configurations of tube bundles in accordance with the invention.
Figure 3:
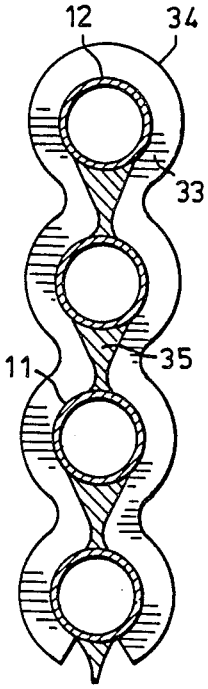
Figure 4:
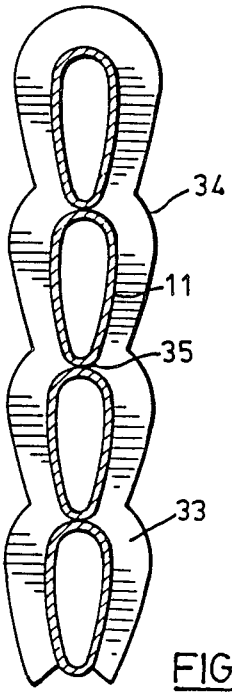

Likewise in FIG. 2, the tubes 11 are shaped with circularly oblong cross sections, and the tubes 11 shown in FIG. 4 are oval in cross section. Contouring the heat exhange sleeves 34 about these more favourable aerodynamic shapes results in higher heat exchange efficiencies between the finned surfaces 33 and the passing stream of cooling gas or other fluid. For example, the form drag of an oval tube 11 as shown in FIG. 4 is only about 10% that of a circular tube. Therefore, use of these and other streamlined shapes for the tubes 11 of each bundle 12 will result in an effective increase of the heat transfer surface of 10 to 20% or more and decrease of the downstream pressure drop.

Figure 6:
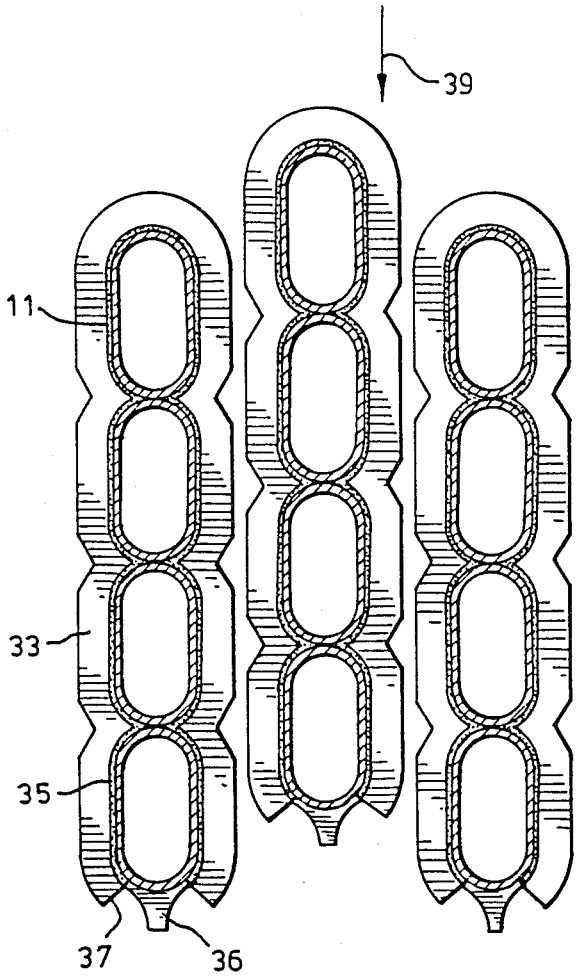
FIG. 6 is a cross-sectional view of a staggered tube bundle arrangement.

Since most heat exchangers in accordance with the invention will comprise a plurality of adjacent tube bundles 12, the flow characteristics of the passing stream of cooling fluid may be further influenced by arranging the adjacent tube bundles 12 in a staggered as opposed to a parallel aligned configuration. Thus, adjacent bundles 12 are offset from one another by about half tube pitch dimension while alternating tube bundles 12 are arranged in parallel (FIG. 6). This staggered tube bundle configuration is felt to be advantageous to give a more even distribution of cooling fluid over the heat exchange finned surfaces 33 of the entire heat exchanger 10 then is the case for bundles 12 arranged in a parallel manner as in FIG. 1.

A further disadvantage of the formation of a low pressure wake region in the cooling gas downstream of a tube 11 is that the drag forces cause the tube 11 to vibrate. In prior devices, this vibration reduces the life of the tube 11, finned tubes and ultimately the entire heat exchanger 10. The invention provides for a great reduction in the amount of vibration caused by the passing stream of cooling fluid by securing the individual tubes 11 into bundles 12 which are wrapped by the heat exchange sleeve 34. This composite structure, especially when streamlined as described above, has a much better resistance to vibration than is the case for conventional structures.

By way of example only, the heat exchange structures 31 shown in FIG. 5 may be produced by hot or cold extrusion of metal sheets or by metal casting techniques. Also, fins 33 may be attached to a surface matrix 32 by welding, soldering, brazing, embedding or gluing thereto. The fin densities are preferred to be in the range of 100 to 800 fins/m with a fin thickness of 0.1 to 1 mm. The fin height depends on the size of the tube 11 to which it is attached, but typically fin heights range from 5 to 300 mm in association with tubes of 5 to 300 mm diameter.

Clearly, the heat exchange structures 31 may be attached to the tube bundles 12 in any of a number of ways while still achieving the object of the invention of easy replacement of damaged fins 33. In addition to forming the structures 31 into sleeves 34 as described above, a heat exchange structure 31 may be formed to and affixed at each side of a tube bundle 12.

Other variations of the invention will be apparent to the person skilled in this art. The scope of the invention including such additional embodiments is defined in the following claims.

We claim:

1. A heat exchanger, comprising:

a plurality of tubes formed into bundle, wherein the tubes are arranged linearly side by side defining an exterior surface shape;

a header structure positioned at one end of the tube bundle to direct a flow of heated fluid into at least one tube of the bundle and to receive a flow of cooled fluid exiting from at least one other tube of the bundle;

means located at the other end of the tube bundle for directing the flow of fluid from said one tube to said other tube of the bundle; and a heat exchange structure positionable about substantially the entire tube bundle in thermal contact therewith, the heat exchange structure having a surface matrix substantially conforming to the shape of the exterior surface of the tube bundle, from which matrix extend a plurality of fins for receiving heat conducted from the tube bundle to the heat exchange structure, the fins being positioned about the tube bundle to define a non-circular fluid dynamic profile about each tube, thereby providing an efficient fluid dynamic shape for receiving a flow of a cooling fluid so that heat may be transferred from the fins to the cooling fluid.

2. A heat exchanger as claimed in claim 1, further comprising a plurality of tube bundles.

3. A heat exchanger as claimed in claim 2, wherein each tube bundle has four tubes.

4. A heat exchanger as claimed in claim 2, wherein the tube bundles are positioned adjacent one another in a parallel array.

5. A heat exchanger as claimed in claim 2, wherein the tube bundles are positioned adjacent one another in a staggered array so that the tubes of alternating bundles are parallel one another with adjacent bundles being offset by about one half of a tube pitch.

6. A heat exchanger as claimed in claim 1, wherein each tube has a circular cross section.

7. A heat exchanger as claimed in claim 1, wherein each tube has an oval cross section.

8. A heat exchanger as claimed in claim 1, wherein each tube has a circular oblong cross section.

9. A heat exchanger as claimed in claim 1, wherein the header structure comprises an inlet, an outlet, and an internal partition for separating the flow of incoming heated fluid and exiting cooled fluid.

10. A heat exchanger as claimed in claim 1, wherein the means at the other end of the tube bundle comprises a reverse header.

11. A heat exchanger as claimed in claim 1, wherein a plurality of heat exchange structures are formed about the tube bundle in thermal contact therewith.

12. A heat exchanger as claimed in claim 1, wherein the heat exchange structure is corrugated to conform to the exterior surface contours of the tube bundle.

13. A heat exchanger as claimed in claim 1, wherein the heat exchange structure is bent into a generally U-shaped sleeve which may be slid over and affixed to the tubes of the tube bundle.

14. A heat exchanger as claimed in claim 1, wherein the heat exchange structure is positioned in thermal contact with the tubes of the tube bundle by means of thermally conductive cement.

15. A heat exchanger as claimed in claim 14, wherein the heat exchange structure is additionally secured about the tube bundle by means of mechanical fasteners.

* * * * *